US006659857B2

(12) United States Patent
Ryan et al.

(10) Patent No.: US 6,659,857 B2
(45) Date of Patent: Dec. 9, 2003

(54) TURBULENCE-FREE LABORATORY SAFETY ENCLOSURE

(75) Inventors: Raymond F. Ryan, Wilmington, NC (US); Alexy Y. Kolesnikov, Wilmington, NC (US)

(73) Assignee: Flow Sciences, Inc., Wilmington, NC (US)

( * ) Notice: Subject to any disclaimer, the term of this patent is extended or adjusted under 35 U.S.C. 154(b) by 0 days.

(21) Appl. No.: 10/193,736

(22) Filed: Jul. 11, 2002

(65) Prior Publication Data

US 2003/0027515 A1 Feb. 6, 2003

Related U.S. Application Data

(60) Provisional application No. 60/304,821, filed on Jul. 11, 2001.

(51) Int. Cl.[7] ..... B08B 15/02
(52) U.S. Cl. ..... 454/56; 454/57
(58) Field of Search ..... 454/56, 57, 59

(56) References Cited

U.S. PATENT DOCUMENTS

| | | | | | |
|---|---|---|---|---|---|
| 3,000,292 | A | | 9/1961 | Wojan | |
| 3,111,077 | A | | 11/1963 | Cortright | |
| 3,237,548 | A | | 3/1966 | Bayern | |
| 3,318,227 | A | | 5/1967 | Nelson et al. | |
| 3,496,857 | A | | 2/1970 | Ellis et al. | |
| 3,747,505 | A | | 7/1973 | Turko | |
| 3,752,056 | A | | 8/1973 | Chamberlin et al. | |
| 4,023,473 | A | * | 5/1977 | Russell | 454/59 |
| 4,177,717 | A | | 12/1979 | Grow et al. | |
| 4,280,400 | A | | 7/1981 | Longworth | |
| 4,409,890 | A | * | 10/1983 | Longworth | 454/57 |
| 4,436,022 | A | * | 3/1984 | Zboralski et al. | 454/59 |
| 4,528,898 | A | | 7/1985 | Sharp et al. | |
| 5,205,783 | A | | 4/1993 | Dieckert et al. | |
| 6,080,058 | A | | 6/2000 | Coe et al. | |

* cited by examiner

*Primary Examiner*—Harold Joyce
(74) *Attorney, Agent, or Firm*—MacCord Mason PLLC

(57) ABSTRACT

The present invention relates to controlled airflow and air distribution within a laboratory safety enclosure and in particular, to turbulence-free airflow within a laboratory fume hood. The fume hood of the present invention has a work chamber and an access opening having an upper edge. A horizontal air deflector structure is positioned adjacent to the upper edge of the access opening to divert a portion of air entering the access opening upwardly within the chamber, whereby the diverted air eliminates an airflow eddy current.

3 Claims, 5 Drawing Sheets

FIG. 1 (Prior Art)
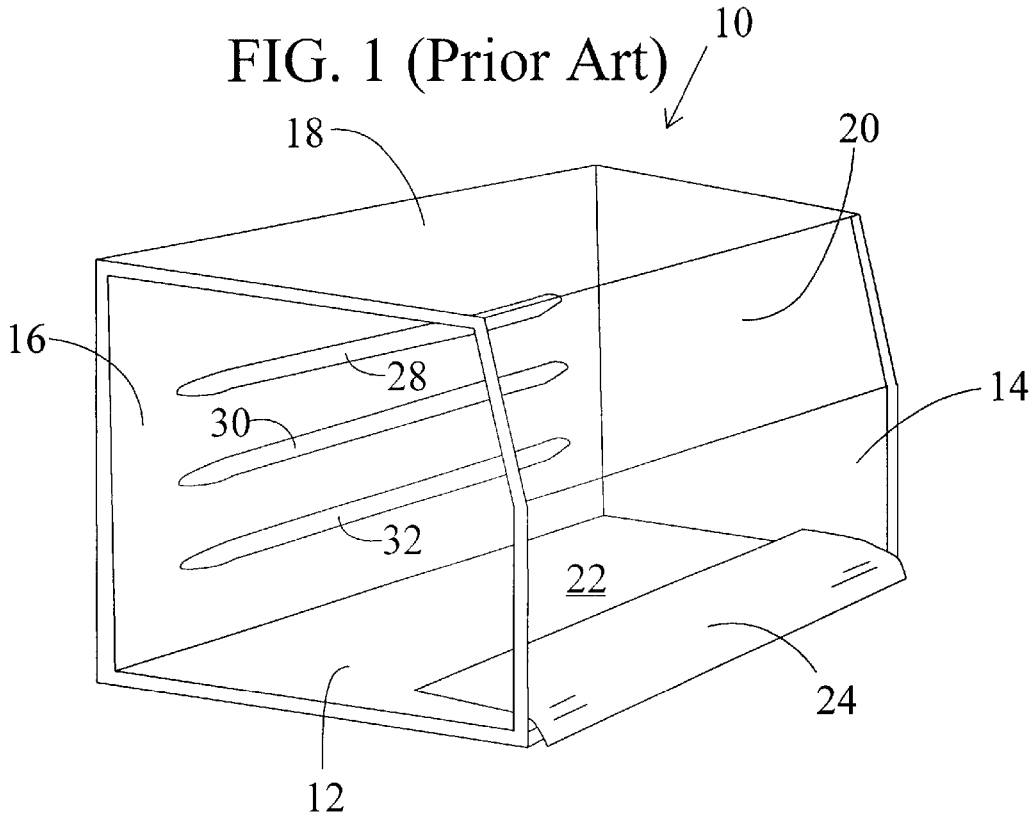
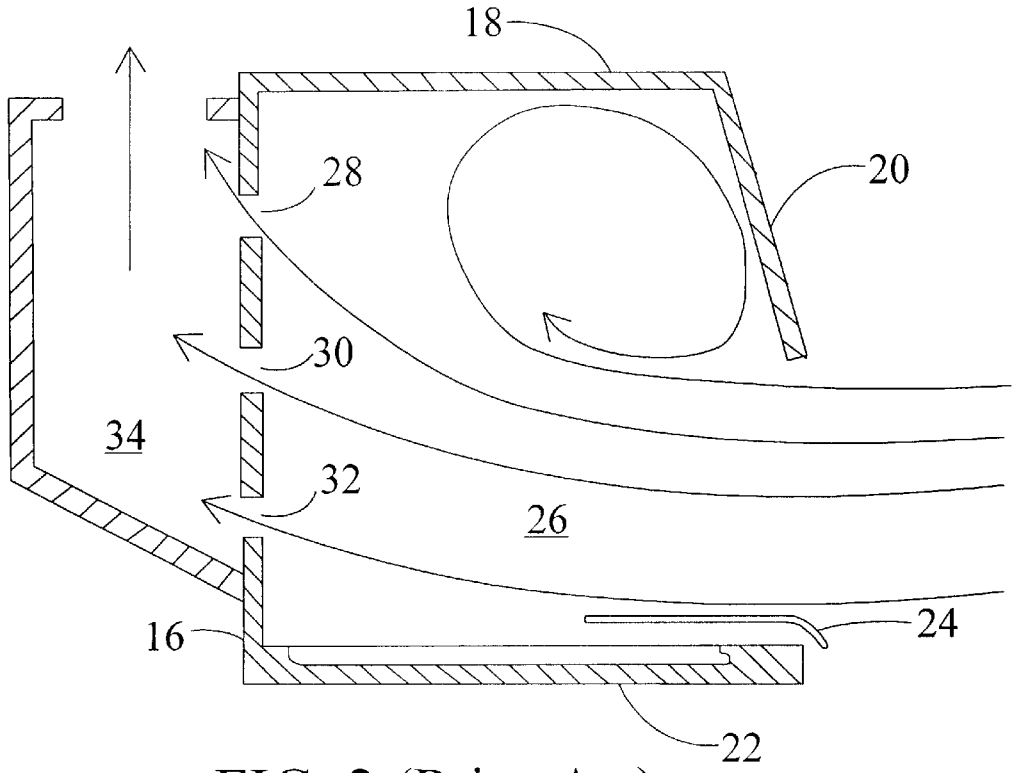
FIG. 2 (Prior Art)

TURBULENCE-FREE LABORATORY SAFETY ENCLOSURE

This application claims the benefit of U.S. Provisional Application No. 60/304,821 filed Jul. 11, 2001.

BACKGROUND OF THE INVENTION

1. Field of the Invention

The present invention relates to controlled airflow and air distribution within a laboratory safety enclosure and in particular, to turbulence-free airflow within a laboratory fume hood.

2. Description of the Prior Art

Fume hoods and laboratory safety enclosures are safety devices used in research, analytical, teaching, and other laboratories. These containment devices provide enclosed work areas where handling of toxic substances can be performed with minimum risk to users. They are used primarily in pharmaceutical, chemical, biological and toxicological laboratory settings.

Specifically, a laboratory safety enclosure such as a fume hood also known as a ventilated workstation is comprised of an enclosure or chamber within which materials are manipulated or worked upon by an operator, and an air exhaust mechanism for removing air from the enclosure.

The enclosure is comprised of a work chamber with an access opening and an exhaust or discharge opening. The enclosure may include a pair of spaced, parallel side walls; rear and upper walls joining the side walls; and a bottom wall or floor that together define the work chamber. The front edges of the side, upper and bottom walls define an access opening or inlet into the chamber through which the operator manipulates material within the chamber. Air also enters the chamber through this access opening as well as through a top or bottom bypass. The hood may also include a moveable closure sash to vary the size of the access opening. The air exhaust opening is preferably located on the opposite side of the chamber from the access opening, so that air flows across the chamber from the access opening to the discharge opening.

Analytically, a laboratory safety enclosure or fume hood is an exhausted enclosure, operating at a negative pressure relative to a room, which vents air away from a user and the laboratory. Generally, fume hoods are designed to maintain a high level of protection, provide a steady balance reading and to ensure that materials inside the enclosure are undisturbed by airflow.

Typically, air enters a fume hood's working chamber through one of three locations, either a sash opening, a top bypass, or a bottom bypass. A constant-speed fan and an automatically controlled variable damper regulate the volumetric flow rate of exhaust air, maintaining a constant face velocity for air entering the access opening of the work chamber. Back baffles are positioned such that air is exhausted directly from the fume hood's work surface as well as the top and center of the working fume hood chamber. Airflow pattern inside of the enclosure work area is controlled mainly by its geometry, sash opening height, face velocity at the inlet opening, operator presence in front of the sash opening, room air currents and very importantly by the geometry of any lab equipment placed inside of the work area itself.

Strict requirements are usually placed on fume hood operating configuration. These primarily include specification of face velocity and sash height ranges. It is generally believed that lowering sash height and increasing (within reasonable limits) face velocity would promote fume hood containment performance. At the same time, increasing face velocity above a certain level would actually compromise containment due to increased turbulence levels inside of the fume hood work area. It would also raise operating costs because of additional air supply demands. Proper fume hood operation therefore requires careful consideration of a variety of mutually dependent parameters.

Experimental smoke test observations as well as computer-predicted numerical simulations show a large vortex behind (downstream of) the bottom of the sash. Results also show the vortex to smoothly follow the back baffles almost to the top baffle in the working chamber. While vortex existence, consistently shown by both experimental and computer-simulated results is generally known, its effect on fume hood containment efficiency has not been addressed until the present invention.

The presence of this vortex results in a large-scale reversed-flow region in the immediate vicinity of the user work-area preventing efficient operation of a fume hood. Even worse, assuming a toxic compound is being handled inside the work area of a fume hood, a large zone with high concentration of toxic fumes is formed directly behind the front face of the hood. In fact, the leading edge of the reversed-flow region is located immediately behind the lower edge of the sash door, providing for a highly unstable containment performance.

Generally, fume hood operation demands a user to continuously perform various tasks inside the work area of a fume hood. These include weighing and measuring chemical compounds, calibrating experimental equipment and simply monitoring equipment performance. Frequent in-and-out hand movement is required to achieve these tasks. The highly unstable airflow balance directly behind the sash door opening is disturbed by this movement, causing highly toxic vapors contained in the reverse flow region to escape fume hood work area.

Moreover, if the sash door were moved to a higher position to facilitate fume hood work area access, there would be an immediate loss of containment due to the presence of the recirculation region directly behind the sash door. It is important to note that some of the highly toxic compounds are not only colorless, but also odorless as well.

Furthermore, increasing face velocity cannot eliminate the presence of the reverse flow region. Increasing face velocity would actually accelerate the roll, making the environment less stable. Increasing the sash opening height would simply make the roll smaller, unless the sash door is fully opened, in which case containment would be lost. Adding a top bypass slot would redistribute the roll, but as a practical matter it would make things worse by providing another potential escape avenue. Worse still, the bypass slot would be directly in front of the operator's face.

Invariably, fume hood design goals are achieved by minimizing turbulence intensity (level of flow fluctuations) characteristic of the airflow inside of a particular laboratory safety enclosure work area. Ideally, a turbulence-free design would provide for a smooth transition of airflow into the enclosure, moving air horizontally across the work surface. The resulting laminar flow structure would promote containment efficiency without affecting balance readings, dispersing light powders or otherwise compromising process efficiency. While turbulence intensity has been reduced by prior art design efforts, it has not been eliminated. What is needed is a fume hood design that allows for turbulence-free operation.

SUMMARY OF THE INVENTION

The present invention provides a fume hood that maintains turbulence-free operation in laboratory environments. The disclosed invention is easily extended to other laboratory safety enclosures used in research, analytical, teaching and other laboratories.

The solution to the problem of turbulence created by the reverse flow vortex is to eliminate it by separating incoming air into two parts. It has been found that the reverse vortex can be swept away by positioning an air deflector structure along and spaced below the upper edge of the access opening to the fume hood's work chamber. The air deflector structure has a front edge that aligns parallel with the upper edge of the access opening. Sections of the air deflector extend upwardly and rearwardly into the work chamber to deflect a portion of incoming air towards the upper region of the work chamber. The deflected air sweeps the reverse vortex away by creating an air current counter that of the reverse vortex.

Computer simulation of the airflow distribution within the chamber is used to design the physical characteristics of the air deflector. As such, the present invention also includes a method for designing a turbulence-free laboratory safety enclosure. Using the present method, a designer begins by defining a computational model that numerically represents the structure of a laboratory hood, including a computational model that numerically represents the structure of an air deflector used to reduce or eliminate turbulent airflow within the laboratory safety enclosure.

A three-dimensional computational fluid dynamics (CFD) analysis is used to predict and optimize airflow velocity and patterns in laboratory fume hoods. CFD is the application of numerical techniques to solve the Navier-Stokes equations for fluid flow. The Navier-Stokes equations are derived by applying the principles of conservation of mass, momentum and energy to a control volume of fluid. The resultant equations are extremely complex and possess no known analytical (exact) solution. Instead, their approximate computer-simulated solutions are sought. In CFD, the Navier-Stokes equations are solved using discretization techniques transforming the original continuous partial differential equation forms into their discrete algebraic counterparts. The resulting algebraic system is then solved utilizing modern computer resources. The result is a detailed velocity, pressure and temperature distributions inside of a given solution domain.

The computational models of the fume hood and air deflector are inputted into the computational resources used to solve the set of computational fluid dynamic equations. An approximation of the airflow within the safety enclosure is generated. The design procedure continues by displaying a representation of the approximation of airflow. The designer then inspects the displayed airflow approximation for regions of turbulence. If regions of turbulence are found, the designer adjusts structural parameters of the air deflector model that he or she thinks will eliminate, reposition or make smaller the regions of turbulence indicated by the display. This process of airflow simulation, displaying of results and adjusting can continue until the desired reduction in turbulence is achieved.

The computational resources are typically a desktop computer running computational fluid dynamics simulation software. The computational fluid dynamics software typically solves a system of algebraic equations generated from Navier-Stokes equations transformed from original continuous partial differential equations. Usually, the computational models are automatically generated by software from computer-aided-drafting (CAD) drawings accessed by the computational fluid dynamics simulation software.

Using the aforementioned method, several air deflector structures have been designed. One air deflector structure is an air deflector plate in the form of an inverted airfoil shape. The plate has a front edge and a rear edge. The plate is positioned within the work chamber such that the front edge of the plate is spaced below and parallel with the upper edge of the access opening to the work chamber. The plate extends rearwardly into the work chamber at an angle of approximately forty-five degrees from the horizontal.

Another embodiment has an air deflector structure in the form of a box shaped baffle that extends upwardly and rearwardly also at an angle of approximately forty-five degrees from the horizontal. The front of the box shaped baffle has an inlet opening that allows airflow to enter the box shape where it is diverted upwardly and rearwardly. The area of the inlet opening is selected to be large enough to allow diverted airflow to counter-balance the reverse vortex. Computer simulated results estimate the size of the box shaped baffle's inlet opening to be about half the size of the access opening. One other constraint is ergonomic, i.e. the dimensions of the opening pertaining to the diverted airflow must be such that the fume hood opening for non-diverted airflow is large enough to provide unobstructed user access to a work area inside the fume hood.

Yet another embodiment of the fume hood of the present invention has an air deflector structure in the form of a curved plate. The plate has a front edge and a rear edge. The plate is positioned within the work chamber such that the front edge of the plate is spaced below and parallel with the upper edge of the access opening to the work chamber. The plate has a horizontal section that blends into an upwardly and rearwardly curving section that blends into another section that curves back to the horizontal as it approaches the top of the fume hood. Slotted openings are spaced at intervals of approximately one-third and two-thirds the length of the plate.

Yet another embodiment of the fume hood of the present invention has an air deflector in the shape of an extended box shaped baffle for deflecting air to eliminate turbulence. In this particular embodiment, the box shaped baffle extends upwardly and rearwardly to well inside the work chamber. As the box shaped baffle approaches the top of the work chamber the baffle inclines to the horizontal for a short distance. Slotted openings are spaced along the bottom of the box shaped baffle at one-thirds and two-thirds intervals along the length of the baffle. Airflow out of these openings opposes the formation of reverse vortices.

Still yet, other embodiments attach the above described air deflector structures to the bottom edge of a movable sash door. The moveable sash door allows greater access to a fume hood's work chamber. In the case of a moveable sash door, the leading edge of the air deflector structure is positioned within the inclined plane of the sash doors travel. The leading edge of the air deflector is parallel to and spaced below the bottom edge of the sash door.

Using the inventive method disclosed herein, one embodiment of the present invention has been developed that performs particularly well at eliminating reverse vortexes. The embodiment is preferred because it has proven to provide superior containment along with substantially turbulence-free operation.

The preferred embodiment is comprised of a fume hood having a work chamber and an access opening leading into the work chamber. The access opening has an upper edge. A horizontal air deflector structure having a plurality of vertically spaced airfoils including an upper airfoil and a lower airfoil are positioned along and spaced below the access opening upper edge.

Each airfoil has a front end, a back end, a forward horizontal section and a rearward upwardly sloping section. The airfoils are vertically stacked such that the front end of each airfoil is aligned within the plane of the access opening. Moreover, the back end of each airfoil is aligned within a plane parallel and rearwardly offset from the plane of the access opening. Furthermore, the angle between rearward upwardly sloping section and horizontal section of each airfoil decreases with each successive airfoil in the stack starting with the upper airfoil progressing to the lower airfoil. In other words, the upper airfoil has the largest angle between its forward horizontal section and rearward section, whereas the lower airfoil has a rearward section that is almost horizontal and the airfoils in between have decreasing angularity beginning with the upper airfoil. The angularity, spacing and number of airfoils in the stack will depend on the particular configuration of the work chamber.

It has been found that while a single airfoil vastly improves the turbulence inside a work chamber, a smaller less problematic reverse vortex exists directly behind the airfoil. The preferred embodiment described above eliminates this smaller vortex by positioning a second airfoil directly below a first. The second airfoil with an upwardly sloping section having a smaller slope angle eliminates the reverse vortex of the first. However, the second airfoil generates its own smaller reverse vortex. Therefore, a third airfoil with an upwardly sloping section having an even smaller slope angle can be added under the second to eliminate the vortex of the second airfoil. Additional airfoils with progressively smaller slope angles may be added to the stack, each eliminating the reverse vortex of the airfoil directly above. Within practical limits, the airfoil stack of the present invention can virtually eliminate turbulence within a work chamber. If the airfoil stack is attached to a movable sash door, a mechanical cam mechanism can be used to vary the angularity of the airfoils for maximum efficiency for all positions of the sash door. Furthermore, a stop on the sash door should be positioned such that the bottom airfoil of the airfoil deflector stack does not come to rest against any part of the fume hood when the sash door is in its closed position.

BRIEF DESCRIPTION OF THE DRAWINGS

In the following drawings all figures except FIG. 1 represent vertical slices through a room and fume hood, taken approximately at the plane of symmetry.

FIG. 1 is a perspective view of one type of general laboratory fume hood.

FIG. 2 is a graphical output of the simulation of airflow in FIG. 1 depicting the reverse flow vortex.

DETAILED DESCRIPTION OF THE PREFERRED EMBODIMENT

Figure 3:
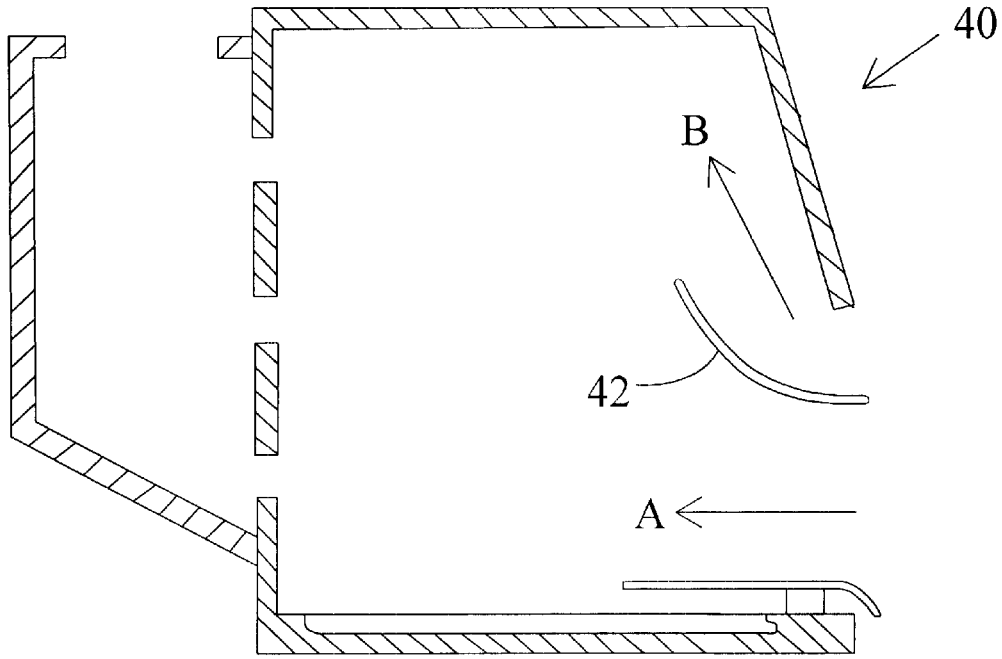
FIG. 3 shows one embodiment of the present invention.

As best illustrated in FIGS. 1 and 2, enclosure 10 is comprised of spaced, parallel side walls 12 and 14; a rear wall 16; and an upper wall formed by a top wall 18 and a front wall 20, extending downwardly from the front edge of top wall 18. Enclosure 10 also includes a floor or bottom wall 22. A bottom airfoil 24 is mounted above the front edge of bottom wall 22 and is configured to enhance laminar airflow over bottom wall 22.

Walls 12–22 together define a work chamber 26 within which material is manipulated. The front edges of walls 12, 14, and 20, along with the leading edge of airfoil 24 define an operator access opening into chamber 26. Rear wall 16 includes horizontal, spaced openings 28, 30 and 32 to allow air to flow from chamber 26 into a plenum 34 through which the air is exhausted into an exhaust conduit (not shown).

Computer simulation and smoke tests performed on the fume hood of FIG. 1 have generated data used to analyze the airflow distribution shown in FIG. 2. Lines and arrows depict a large reverse airflow vortex behind the bottom of front wall 20.

Figure 4:
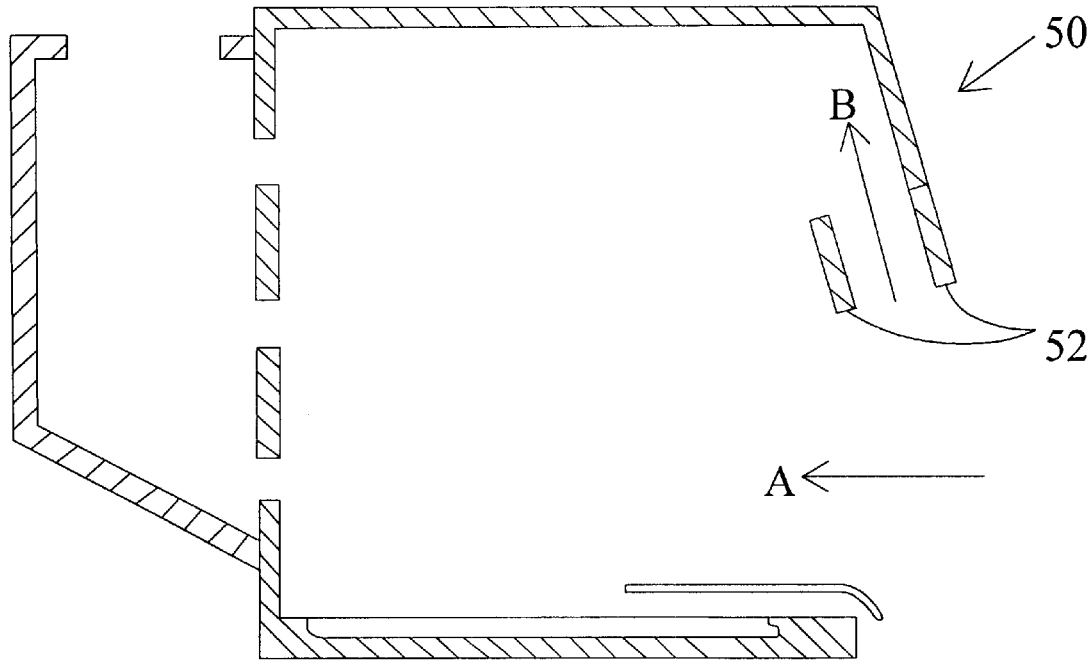
FIG. 4 depicts another embodiment of the present invention.

Lines with arrows shown in FIGS. 3–9 depict the direction of airflow associated with the operation of the fume hoods of the present invention. The present solution to the problem of turbulence generated by a reverse airflow vortex is illustrated in FIGS. 3 and 4. In both cases, an air deflector separates the airflow entering the fume hood into two separate parts, part A and part B. The airflow corresponding to part A is similar to that of a conventional fume hood. Airflow corresponding to part B eliminates the reverse flow vortex. Both configurations, that of FIG. 3 and that of FIG. 4 achieve the intended result of eliminating recirculation flow.

In FIG. 3, a fume hood 40 is equipped with an air deflector plate 42 for directing airflow B upwardly and rearwardly has the form of an inverted airfoil shape that is positioned horizontally and preferably rearwardly at an angle of approximately forty-five degrees from the horizontal. FIG. 4 shows a fume hood 50 that has a deflector in the form of a box shaped baffle 52 that extends upwardly and rearwardly at an angle of approximately forty-five degrees from the horizontal. The front of box shaped baffle 52 has openings that allow airflow to enter the box shape where it is diverted upwardly and rearwardly. It is important to note, that the size of the region accommodating diverted airflow B should be large enough for sufficient airflow to counter-balance the reverse motion. Computer simulated results estimate the size of the region containing airflow B to be about half the size of region encompassing airflow A. One other constraint is ergonomic, i.e. the dimensions of the opening pertaining to airflow B must be such that the fume hood opening for airflow A is large enough to provide unobstructed user access to a work area inside the fume hood.

Figure 5:
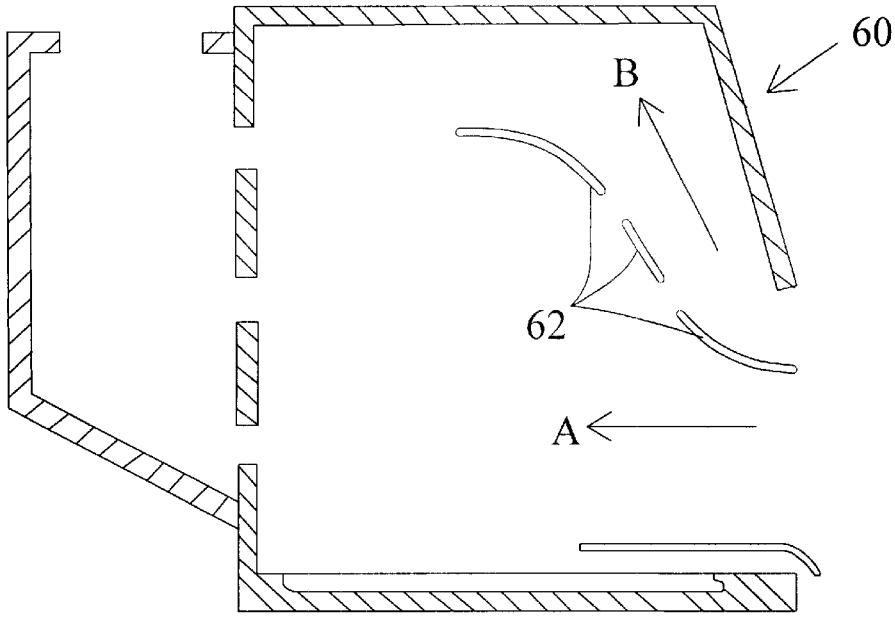
FIG. 5 shows a potential modification of FIG. 3.
Figure 6:
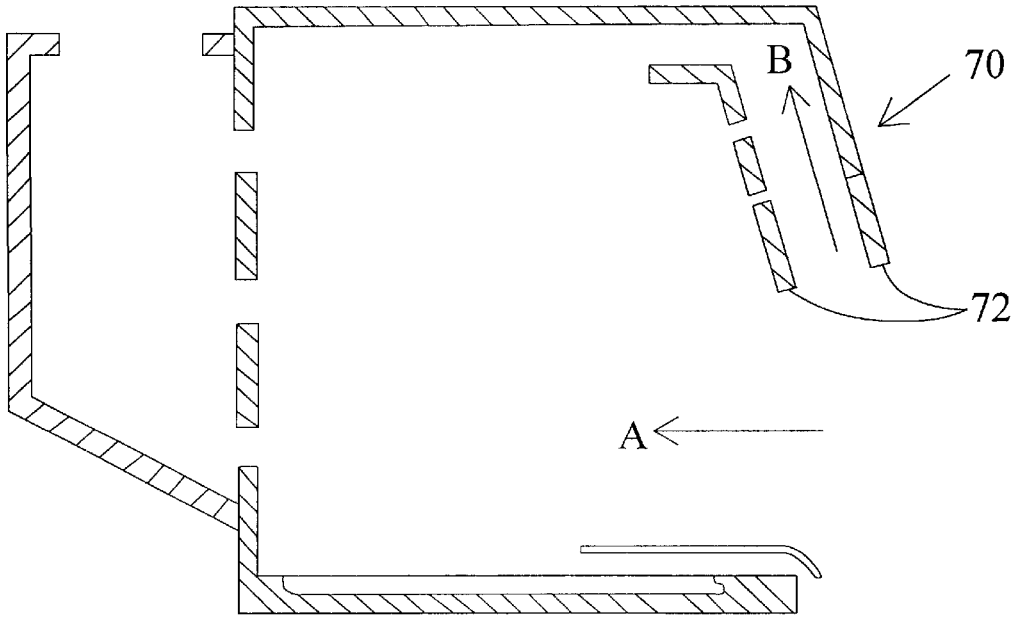
FIG. 6 shows a potential modification of FIG. 4.

FIGS. 5 and 6 depict modifications to the air deflector diverting airflow B. In FIG. 5, a fume hood 60 is equipped with an extended air deflector plate 62 that extends further upwardly and rearwardly, curving back to the horizontal as it approaches the top of fume hood 60. Slotted openings are spaced at intervals of approximately one-third and two-thirds the length of the baffle. FIG. 6 shows a fume hood 70 equipped with an extended box shaped baffle 72 that is directed upward and rearward at approximately forty-five degrees. As extended box shaped baffle 72 approaches the top of the fume hood it curves to horizontal for a short distance. Similar to FIG. 5 slotted openings are spaced at one-third and two-thirds intervals along the length of extended baffle 72. In both cases, these modifications would provide better control over incoming airflow distributions.

Figure 7:
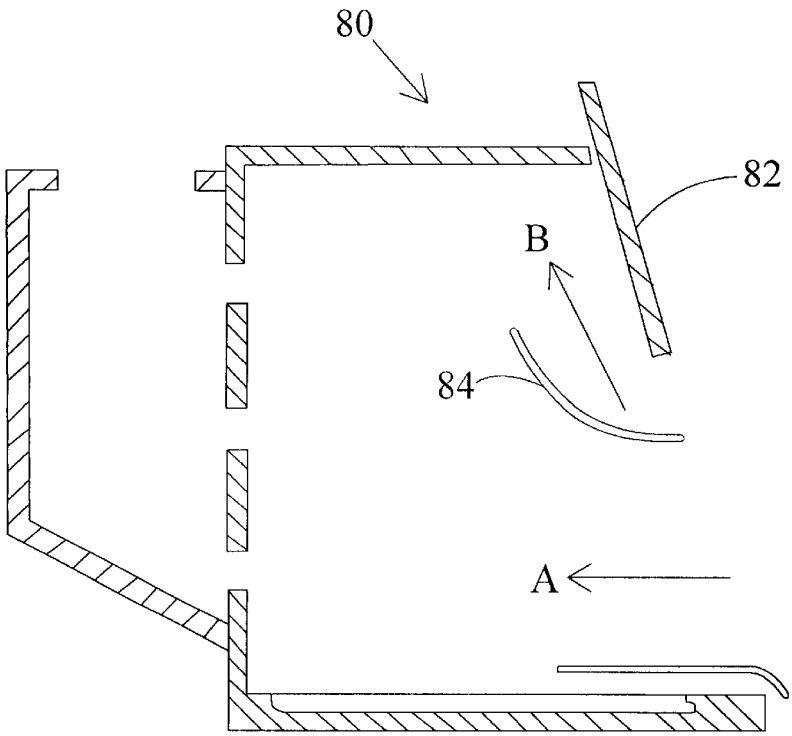
FIG. 7 shows a movable sash adaptation for FIG. 3.

FIG. 7 shows a fume hood 80 including a movable sash door 82 allowing greater access to the fume hood work area.

An air deflector in the form of an inverted airfoil 84 is fixed to sash door 82. The leading edge of airfoil 84 is positioned within the inclined plane of sash door 82. The leading edge of airfoil 82 is parallel to and spaced below the bottom edge of sash door 82. Airfoil 84 also curves upward and rearward toward the upper work chamber region of fume hood 80.

Figure 8:
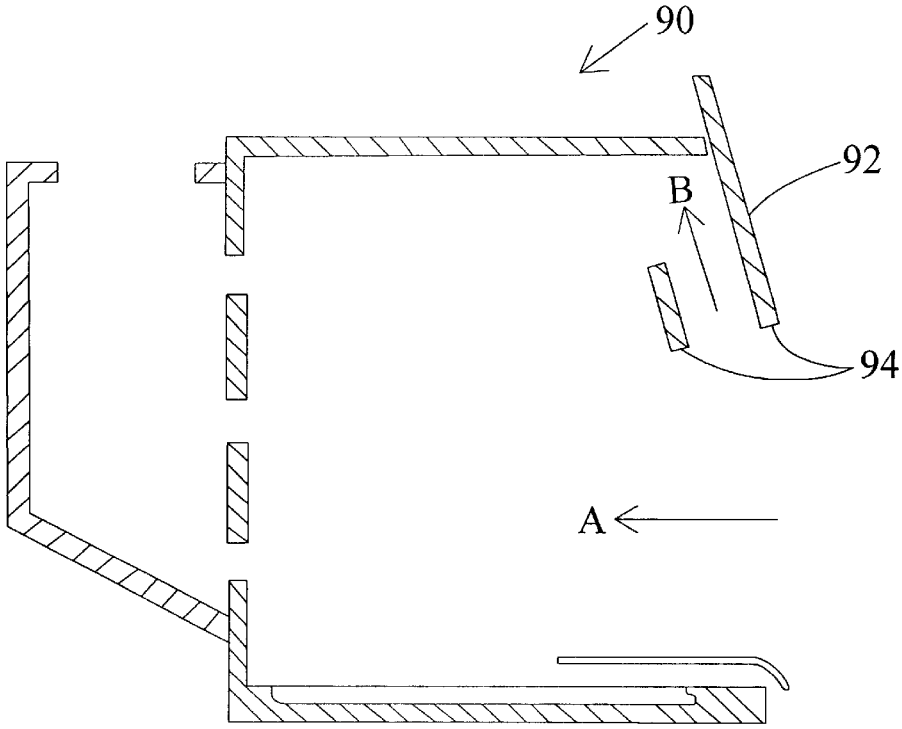
FIG. 8 shows a movable sash adaptation for FIG. 4.

FIG. 8 shows a fume hood 90 including a sash door 92. A box shaped baffle 94 extruded from sash door 92 directs airflow B upwardly and rearwardly at an angle of approximately forty-five degrees. In contrast to the immovable air deflectors shown in FIGS. 3 and 4, the air deflectors depicted in FIGS. 7 and 8 move in concert with the sash.

Figure 9:
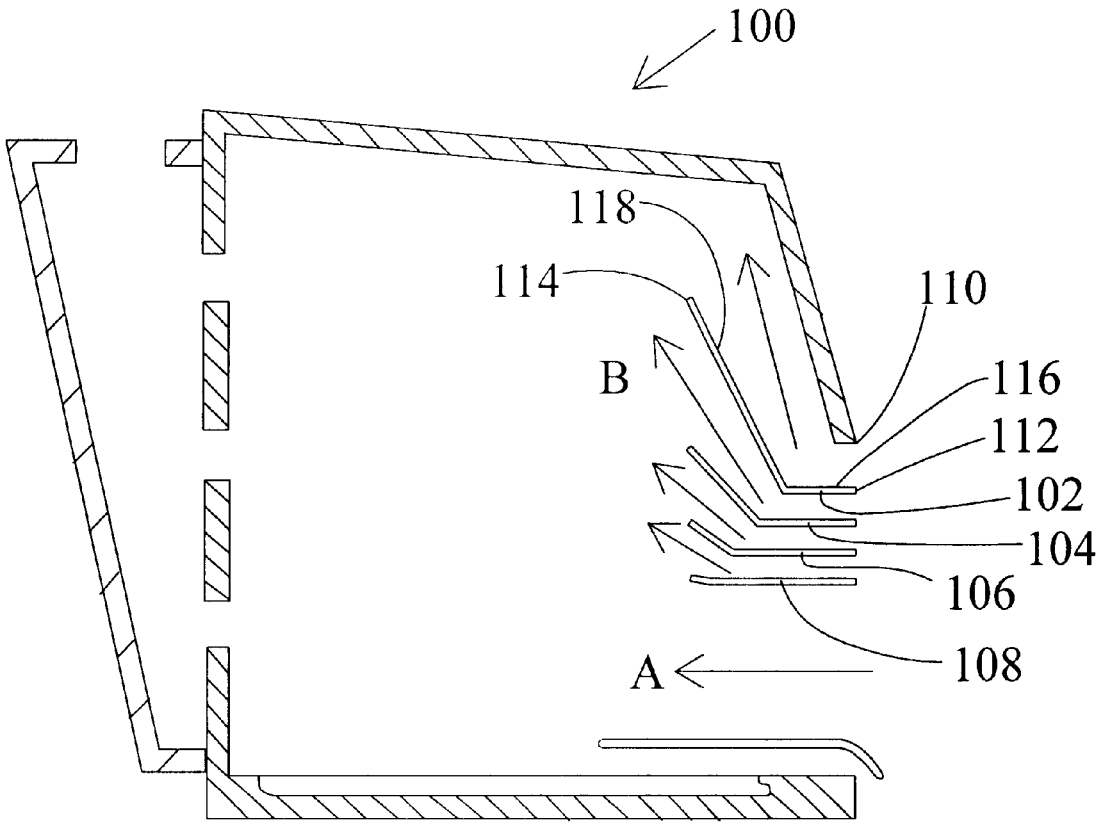
FIG. 9 depicts a preferred embodiment of the present invention.

FIG. 9 shows a fume hood 100 equipped with a horizontal air deflector structure made up of a vertical stack of airfoils. An upper airfoil 102 and a lower airfoil 104 sandwich two inner airfoils 102 and 104. The access opening to fume hood 100 has an upper edge 110. Airfoil 102 has a front edge 112, a back edge 114, a forward horizontal section 116 and a rearward upwardly sloping section 118.

Similarly, airfoils 102, 104 and 106 each have a front end, a back end, a forward horizontal section and a rearward upwardly sloping section. The airfoils are vertically stacked such that the front end of each airfoil is aligned within the plane of the access opening. Moreover, the back end of each airfoil is aligned within a plane parallel and rearwardly offset from the plane of the access opening. Furthermore, the angle between rearward upwardly sloping section and horizontal section of each airfoil decreases with each successive airfoil in the stack starting with the upper airfoil progressing to the lower airfoil.

While FIGS. 3–9 illustrate the present invention, the exact dimensions of the openings and directional cutouts or baffles depend on the enclosure size and can be determined by computer simulations and prototype testing. Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A turbulence-free ventilated workstation comprising:

a) a work chamber having an access opening into the work chamber, the access opening having an upper edge;

b) a plurality of vertically spaced airfoils including an upper airfoil and a lower airfoil, said airfoils being positioned along and spaced below the upper edge of the access opening, each of said vertically spaced airfoils have an upwardly angled inner section with the angle of each inner section decreasing from the upper airfoil to the lower airfoil to divert a portion of the air entering the access opening upwardly within the chamber, whereby said diverted air eliminates an airflow eddy current.

2. The ventilated workstation of claim 1, wherein each of said vertically spaced airfoils have a front end, said front end of each airfoil being aligned in the plane of said access opening.

3. The ventilated workstation of claim 1, wherein each of said vertically spaced airfoils have a back end, said back end of each airfoil being aligned within a plane parallel and rearwardly offset from the plane of the access opening.

* * * * *